United States Patent [19]

Gaines

[11] 4,314,157

[45] Feb. 2, 1982

[54] SAFETY LOCK FOR RADIOGRAPHY EXPOSURE DEVICE

[75] Inventor: Thomas M. Gaines, Albany, Calif.

[73] Assignee: Industrial Nuclear Company, Inc., Foster City, Calif.

[21] Appl. No.: 50,612

[22] Filed: Jun. 21, 1979

[51] Int. Cl.[3] ..... G21F 5/02; G05G 5/06; E05B 55/02; E05B 63/20

[52] U.S. Cl. ..... 250/497; 250/496; 292/333; 74/527; 70/157; 70/174; 70/181

[58] Field of Search ..... 250/496, 497; 292/333; 74/527, 2, 615; 70/174, 181, 240, 256, 379 R, 380, 157

[56] References Cited

U.S. PATENT DOCUMENTS

| | | | |
|---|---|---|---|
| 562,077 | 6/1896 | Hasshagen | 292/333 |
| 887,354 | 5/1908 | Sterrett | 292/333 |
| 1,400,615 | 12/1921 | McCalmont | 70/181 X |
| 2,139,193 | 12/1938 | Lamothe et al. | 292/333 X |
| 2,602,349 | 7/1952 | Manning | 74/527 X |
| 2,654,813 | 10/1953 | Hall | 74/527 X |
| 2,824,461 | 2/1958 | Hoeltje et al. | 74/527 X |
| 3,126,484 | 3/1964 | Meeder et al. | 250/497 |
| 3,170,065 | 2/1965 | Prest | 250/497 |
| 3,562,532 | 2/1971 | Santoro et al. | 250/497 X |
| 3,669,093 | 6/1972 | Sauerwein et al. | 250/497 X |
| 3,939,355 | 2/1976 | Rosauer | 250/497 |

FOREIGN PATENT DOCUMENTS

| | | | |
|---|---|---|---|
| 528260 | 7/1956 | Canada | 74/527 |
| 895079 | 10/1953 | Fed. Rep. of Germany | 74/527 |
| 797091 | 6/1958 | United Kingdom | 292/333 |
| 1056127 | 1/1967 | United Kingdom | 70/252 |

*Primary Examiner*—Francis K. Zugel
*Assistant Examiner*—Carl F. Pietruszka
*Attorney, Agent, or Firm*—Phillips, Moore, Weissenberger, Lempio & Majestic

[57] ABSTRACT

A safety lock for securing a radiation source in a radiography exposure device is disclosed. The safety lock prevents the inadvertent extension of the radiation source from the exposure device. The exposure devices are used extensively in industry for nondestructive testing of metal materials for defect. Unnecessary exposure of the radiographer or operator occurs not infrequently due to operator's error in believing that the radiation source is secured in the exposure device when, in fact, it is not. The present invention solves this problem of unnecessary exposure by releasingly trapping the radiation source in the shield of the radiography exposure device each time the source is retracted therein so that it is not inadvertently extended therefrom without the operator resetting the safety lock, thereby releasing the radiation source. Further, the safety lock includes an indicator which indicates when the source is trapped in the exposure device and also when it is untrapped. The safety lock is so designed that it does not prevent the return of the source to the trapped, shielded position in the exposure device. Further the safety lock includes a key means for locking the radiation source in the trapped position. The key means cannot be actuated until said radiation source is in said trapped position to further insure the safety lock cannot be inadvertently locked with the source untrapped and thus still extendable from the exposure device.

10 Claims, 10 Drawing Figures

EXTEND
RETRACT
20
22
24
26
28
30
32
34
36
38
40
42
43
44
46
47
48
50
52
54
56
58
60
2

SAFETY LOCK FOR RADIOGRAPHY EXPOSURE DEVICE

TECHNICAL FIELD

The present invention relates to a radiography exposure device for nondestructive testing of metallic materials for defects, and in particular, to a safety lock for securing a radiation source in a shield of the exposure device.

BACKGROUND ART

Radiography exposure devices which can contain sealed sources of gamma emiting isotopes, such as for example iridium-192 and cobalt-60, are extensively used in industry to nondestructively test metallic metals for defects. For example, such tests can be carried out to determine the integrity of welded connections between sections of a pipeline to be used for transporting oil. The radiography exposure device includes a shield which isolates the radiation source or gamma emiting isotopes from the operator or radiographer and the surrounding environment. A safety lock is used to removably secure the source in the shield when the device is not in use. On occasions, safety locks have failed to perform this intended function and that failure has contributed to unnecessary exposure to the radiographer and others in the immediate vicinity when the radiation source was inadvertently extended from the shield.

In the past, radiation survey meters have been used to indicate the general level of radiation about the device. However, there exists a need to provide a positive means for identifying the location and state of the source to supplement the survey meters in order to minimize the errors of the radiographers.

Position indicator lights have been used on radiographic exposure devices with generally unsatisfactory results. The switches controlling the lights occasionally malfunction, often due to the severe condition which the exposure devices are subject. As the indicator lights are the easiest available indication of source position, radiographers using the indicator lights reduce their use of accompanying survey meters owing to their belief that the indicator lights provide adequate protection. Such reliance on these indicator lights has resulted in a number of overexposures due to their malfunction. Thus again there is a need for a positive source location indicator which is not subject to the extreme conditions such as the dirty, muddy, and often gritty environment surrounding for example, the construction of an oil carry pipe.

A safety lock used in the industry includes a lock mechanism mounted at top of a knurled and rotatable cylinder. The source is mounted at the end of a flexible cable and the flexible cable is provided through a bore in the cylinder. The turning of the cylinder selectively locks the source in the shield of the radiography exposure device. Further with the shield so locked, the cylinder itself may be locked with the lock mechanism to prevent the unauthorized positioning of the cylinder.

Such a device has several problems. First, although the various positions of the cylinder are stamped thereon, it has been found that such indicia cannot provide sufficiently positive identification of the location of the source. Further, should the cylinder be returned to the locked position with the source extended from the shield, the source cannot be located in the shield until the cylinder is properly positioned.

Another prior art device includes a touch latch type lock such as, for example, found on cabinet doors wherein the latch is pushed inwardly to open and alternatively pushed inward to close. For this device to operate, first the cable on which the radiation source is mounted must be pulled out the back of the lock allowing an intermediate release of the radiation source. Concurrently with this intermediate release, an indicator provides a visual indication of the intermediate release of the source. The indicator must then be rotated in order to release the source so that it may be pushed forward, out of the shield and into position for making the necessary tests. Upon retraction of the source into the shield, the cable is pulled out the back of the safety lock, tripping the touch latch and locking the source in a safe position relative to the shield. This prior art device has the disadvantages that it is too expensive to produce and has too many moving parts which can malfunction due to mechanical fatigue or due to the introduction of dirt, grit and other contaminants into said lock.

Due to the problem of unnecessary exposure, the U.S. Nuclear Regulatory Commission published in the Federal Register, Volume 43, No. 59, on Monday, Mar. 27, 1978 an advance notice of proposed rule making set out certain guidelines for safety locks for radiography exposure devices. These guidelines are as follows:

1. The radiography exposure device shall have a lock which is not easily removable with readily available tools.
2. When the device is locked, it shall not be possible to remove the source from the exposure device or to move the source shielding as to expose the source.
3. The safety lock shall not prevent return of the source to a shielded position.
4. It shall not be possible to unlock the exposure device with any easily available substitute for the key.
5. It shall not be possible to operate the safety lock unless the source is in the fully shielded position.
6. It shall not be possible to remove the source from the back of the exposure device when the safety lock is unlocked.

Further, the Nuclear Regulatory Commission has indicated that there is a need for positive indication of the position of the source. This positive position is to supplement the use of a survey meter to minimize radiographer error as to the location of the source.

SUMMARY OF THE INVENTION

The present invention is directed to overcoming one or more of the problems as set forth above.

In one aspect of the invention a lock for securing a radiation source in a shield, wherein the radiation source is secured to a flexible member which has a stop spaced from the radiation source, comprises means for trapping the stop, said means having a trapping and an untrapping position. Further, the lock includes first means for biasing said trapping means to the trapping position, and means for receiving said stop means, which receiving means has engaging means for engaging said trapping means, said receiving and engaging means having an engaging position and a releasing position. Further the lock includes second means for biasing said receiving and engaging means toward the engaging position so that said engaging means can engage said trapping means in the trapping position, and wherein said trapping means is urged to the trapping position by said first biasing means with the engaging means in the release position.

In another aspect, the flexible member has a connector spaced from the stop, and the receiving means defines a passage for receiving the portion of the flexible member between the stop and the connector so that the connector extends out of the passage. The action of pulling on the connector moves said receiving and engaging means to the release position.

In yet another aspect of the invention, the trapping means includes a slide having an indicator tab extending from the housing of the lock and wherein the tab extends farther from said housing with the trapping means in the trapping position than with said means in the untrapping position. The tab can be urged into said housing against the first biasing means to position said trapping means in the untrapping position.

In yet another aspect of the invention, the trapping means includes another trapping position and the safety lock includes a key lock which can only be operated when the trapping means is in the another trapping position, which can only occur when the stop is trapped by the trapping means.

Thus, it can be seen that the present invention meets the safety guidelines set out by the Nuclear Regulatory Commission in that the lock does not prevent the return of the source to a shielded position wherein the stop is trapped in the trapping means and further a key lock cannot be operated until the stop is received in the trapping means and thus the source is properly located in the shielded position. Further, the indicator tab gives a positive indication to the operator as to the location of the source relative to the exposure device. Thus as the key lock cannot be operated to immobilize the trapping means in the another trapping position until the source is properly shielded in the exposure device, there can be no inadvertent removable of the source from the shield due to the locking of the key lock when the source is not properly positioned, so that the source can still be extended from the exposure device.

Further, the present invention is designed so that it is not possible to remove the source from the back of the exposure device and so that the lock is not readily removable with available tools and further cannot be opened with an easily available substitute for the key.

DETAILED DESCRIPTION OF THE PREFERRED EMBODIMENT

Figures 1, 2, 3:
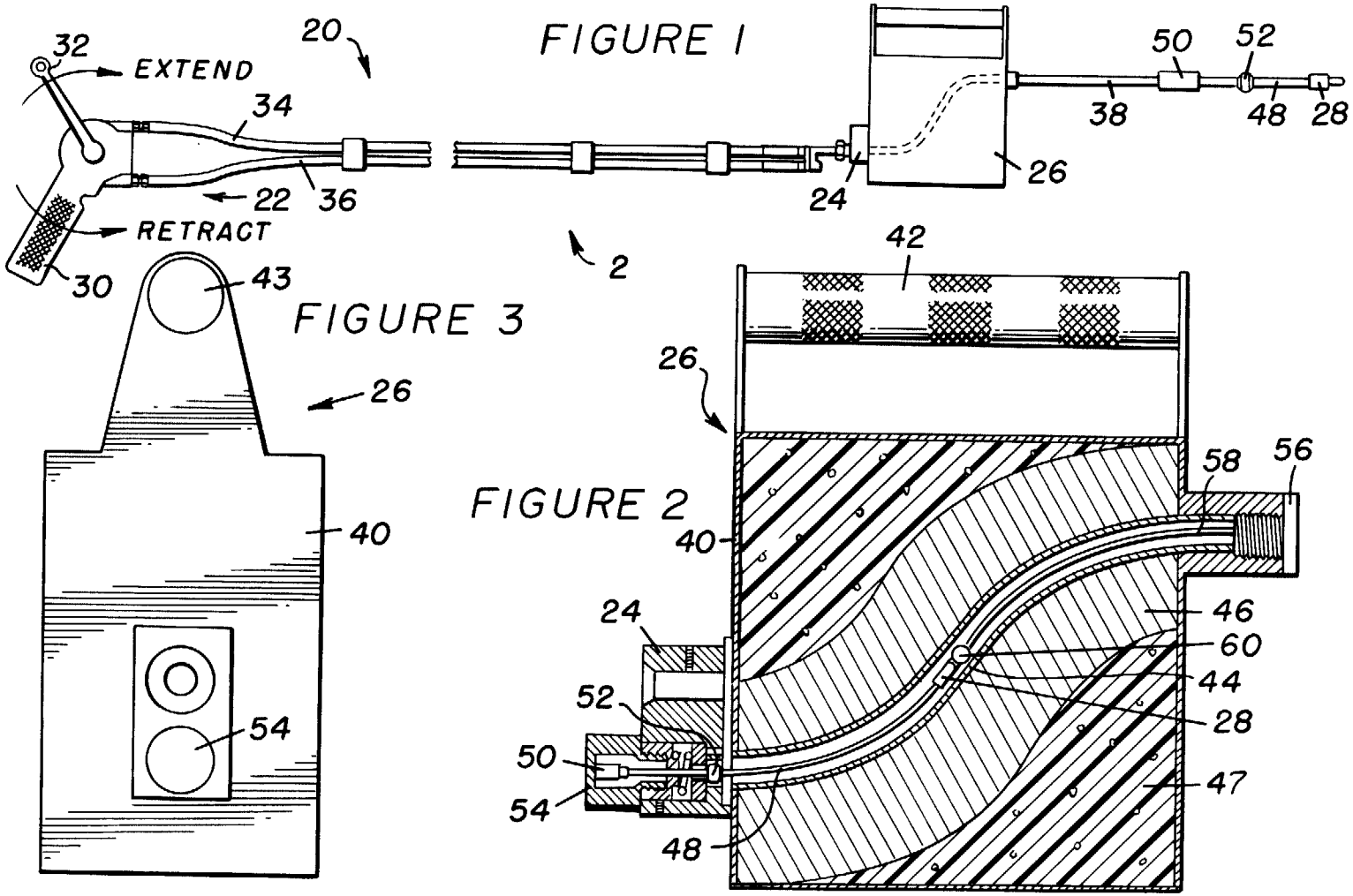
FIG. 1 is a side view of a radiography exposure device incorporating the safety lock of the invention.
FIG. 2 is an enlarged side view, partially sectioned of the shield of the radiography exposure device with the safety lock of the invention affixed thereto.
FIG. 3 is a side elevational view of the shield of FIG. 2.

With reference to the figures and particularly to FIG. 1, a radiography exposure device 20 is depicted. The device 20 includes a pistol grip cable drive 22, the safety lock 24 of the invention, a shield 26 and a source of radiation 28 which is shown extended from the shield 26. The pistol grip cable drive 22 includes a pistol grip 30 and a crank 32 rotatably mounted thereto. Crank 32 can extend radiation source 28 from shield 26 when it is turned in the indicated clockwise direction and can retract source 28 into shield when the crank is turned into the indicator counterclockwise direction. Cable drive 22 further includes cable guide tubes 34 and 36. Guide tube 34 is connected to lock 24 and guide tube 36 is positioned dependently below guide tube 34. When the radiation sources is being extended from the shield 26, the cable 38 upon which the radiation source 28 is mounted moves from cable guide tube 36 around crank 32 and through cable guide tube 34. When the source 28 is being retracted into shield 26, the cable 38 moves through cable guide tube 34 around crank 32 and is stored in cable guide tube 36. It is to be understood that the radiographer or operator of the radiography exposure device for purposes of safety stands many feet away from the shield 26 when the source 28 is extended therefrom in order to make the above reference inspections. Thus, the cable guide tubes 34 and 36 are many feet long so that the pistol grip 30 is quite removed from the shield 26. Further as the source 28 must in some instances be moved many feet outside of the shield in order to be correctly positioned for making the necessary inspections, the cable guide tube 36 must be sufficiently long to store the excessive cable length as the source of radiation 28 is retracted into the shield 26.

Examining the shield 26 and the safety lock 24 of the invention, it can be seen in FIG. 2 that the shield 26 includes a housing 40 and a carrying handle 42. An S-shaped tube 44 is provided in the housing 40 for receiving the source of radiation 28. S-shaped tube 44 is comprised of titanium in a preferred embodiment. It is to be appreciated that the radiation source 28 is held in the middle of the S-shaped tube in the locked or stored position to further isolate the radiation source from the openings at the end of said S-shaped tube which are then not in line with said radiation source. Surrounding the S-shaped tube 44 is radiation shield material 46 which isolates the radiation source 28 from the environment. Radiation shield material 46 is supported and cushioned by foam material 47.

Figure 4:
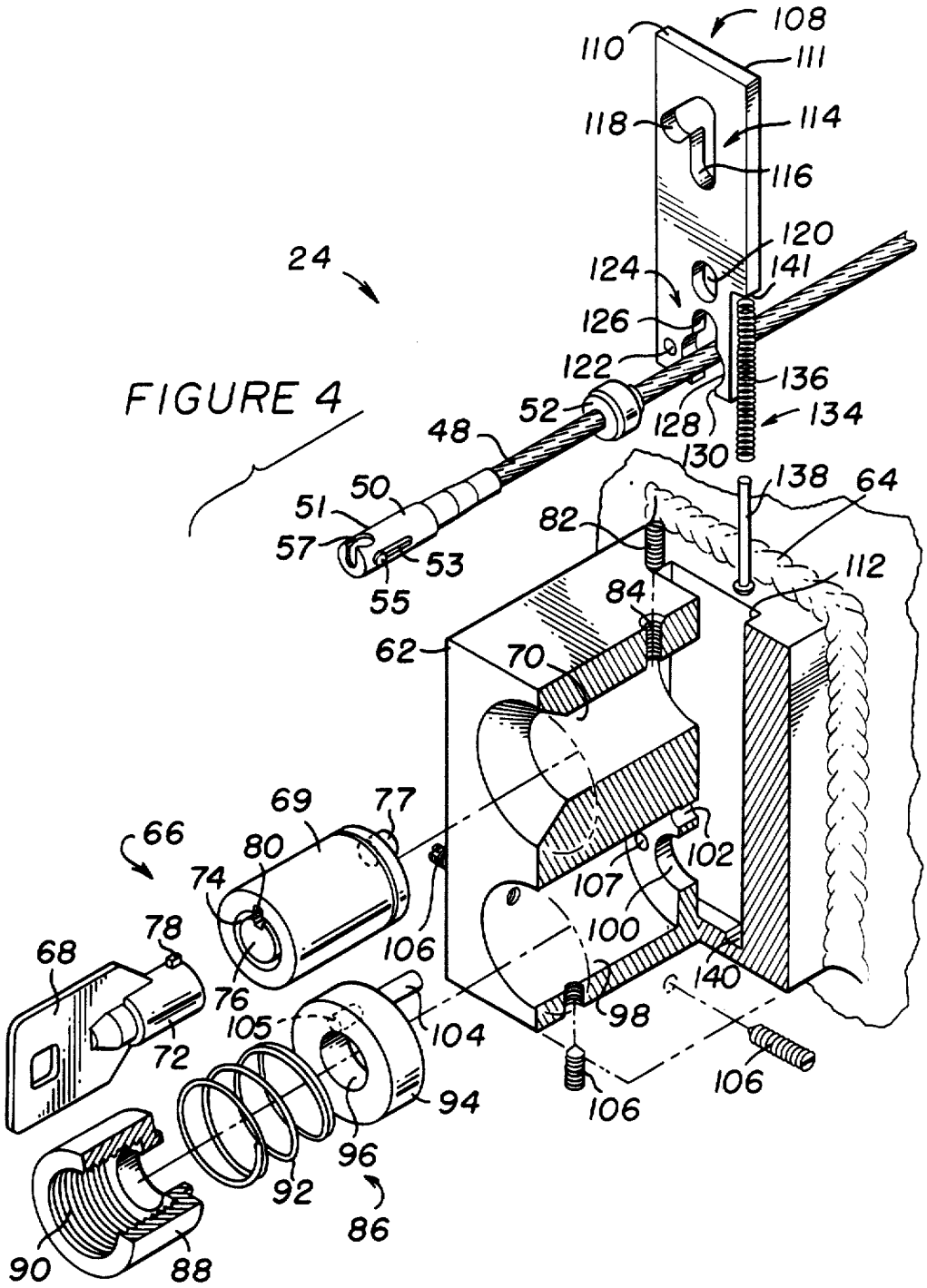
FIG. 4 is an exploded perspective view of an embodiment of the safety lock of the invention.

As presented in FIG. 2, the shield 26 contains the radiation source 28 in a locked and secure position so that the shield and the source can be transported to the work site. For the purpose of transportation, the cable 38 includes a disconnectable pig tail 48 onto which the radiation source 28 is mounted. A cable connector 50 is located on the opposite end of pig tail 48 from the radiation source 28. As can be seen in FIG. 4, connector 50 includes a housing 51 which contains a spring biased pin 53 which is actuated by peg 55. With pin 53 moved rightwardly in FIG. 4 a mating end of the cable 38 can be inserted in slot 57 defined by housing 51. When peg 55 and thus pin 53 are released, cable 38 is positively locked in connector 50. Spaced from the radiation source 28 is a stop 52 which is selectively trapped by the safety lock 24 of the invention, as will be discussed hereinbelow.

For purpose of transportation, a cap 54 is placed over the connector 50 to prevent dust and other contaminants from entering the safety lock 24. Additionally, for purposes of safety and transportation, a safety plug 56 is inserted into the end of the S-shaped tube 44 from which the radiation source 28 extends. Safety cap 56 includes a short pig tail cable 58 with a blunted end 60. End 60 is positionable immediately adjacent the radiation source 28, in the middle portion of the S-shaped tube 44, for purposes of isolating and positively positioning the radiation source 28 during transportation of the shield 26. FIG. 3 depicts an end elevational view of the shield 26 with the cap 54 placed over the end of the connector 50.

Turning to FIG. 4, an exploded perspective view of the safety lock 24 of the invention is depicted. Safety lock 24 includes a lock housing 62 which is welded along line 64 to the housing 40 of the shield 26 with a heli-arc welding technique so the lock housing cannot be easily removable from the shield 26. Safety lock 24 further includes a locking means on cylindrical key lock 66 having key 68, which locking means 66 is received in a first bore 70 defined by the lock housing 62. Bore 70 is counter sunked to receive the flange portions of the key 68. Key 68 is of the type having a cylindrical barrel 72 which is received in annular channel 74. Cylinder barrel 72 includes teeth (not shown) on the internal surface thereof, which teeth mate with the cylinder key lock housing 69 to allow an internal portion 76 of the cylinder key lock 66 and pin 77, eccentrically mounted to internal portion 76, to turn as key 68 is turned. Upstanding from cylinder barrel 72 is a tab 78 which is slidable into a key way 80. When the key 68 is inserted in the cylinder key lock housing 69 and turned to effect turning of the eccentric pin 77, tab 78 lockingly secures key 68 in housing 69. The non-rotating outer portion of housing 69 is positionably secured with respect to the housing 62 of the safety lock 24 by a set screw 82 received in threaded bore 84.

Located immediately below cylindrical key lock 66 is the means 86 for receiving the stop 52 of the pig tail cable 58. Said receiving means 86 includes a retaining cylinder 88 defining a central threaded bore 90 for receiving a mating end of cable guide tube 34. Further, receiving means 86 includes a spring 92 and a annular receiver 94 having a central bore 96. Receiving means 86 is received in a second bore 98 defined by lock housing 62. Further, housing 62 defines additional bores 100, 102 and 107 which communicate with bore 98. Bore 96 of receiver 94 is aligned with bore 100 and engaging means or pins 104 and 105, extending from receiver 94, are received through bores 102 and 107. As will become apparent hereinbelow, pin 104 extends farther from receiver 94 than does pin 105. The spring 92 is held between retaining cylinder 88 and receiver 94 in bore 98 and said retaining cylinder 88 is held in position relative to bore 98 by a plurality of said set screws 106.

Safety lock 24 includes a trapping means 108 which includes a slide 110 received in a rectangular passage 112 defined by lock housing 62. As can be seen in FIG. 4, bores 70 and 98 are substantially parallel to each other and perpendicular to slide 110 and passage 112. The upper end of slide 110 includes an indicator tab 111. Slide 110 includes a first aperture 114 which has a first substantially vertical and elongate aperture portion 116 and a second sloping and elongate aperture portion 118 directed downwardly from the upper most portion of the vertical portion 116.

Slide 110 further includes an additional elongate bore 120 which is positioned to selectively receive the end of pin 104 which extends from annular receiver 94. Located adjacent the bottom portion of slide 110 is an indentation 122 which can selectively receive the end of pin 105. Adjacent indentation 122 and communicating with the lower edge of slide 110 is an additional aperture 124. Additional aperture 124 includes an upper portion 126 which is sized to receive pig tail cable 48 but not stop 52 and a middle portion 128 which is sized to receive stop 52 which communicates with upper portion 126. Further, aperture 124 includes a lower portion 130 which communicates with middle portion 128 and with the lower edge of slide 110. Lower portion 130 is sized to receive the pig tail cable 48 but not the stop 52. Slide 110 is biased upwardly in rectangular passage 112 by a spring arrangement 134. Spring arrangement 134 includes a spring 136 and a guiding and supporting elongate pin 138. Spring 136 and pin 138 are received in passage 112 with the head of pin 138 being received in an indentation 140 which communicates with said passage 112. Further, an end of spring 134 contacts a shoulder 141 of slide 110.

OPERATION OF THE INVENTION

Figure 6:
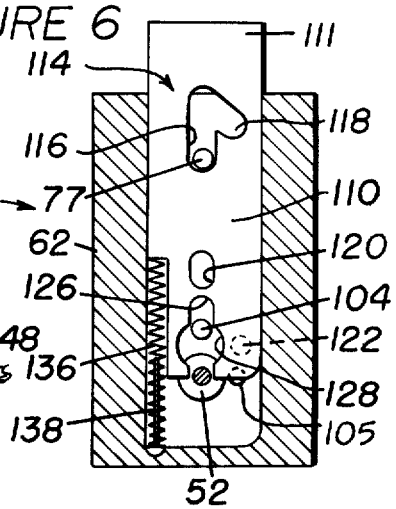
FIG. 6 is an right end, partially sectioned view of FIG. 5.
Figure 7:
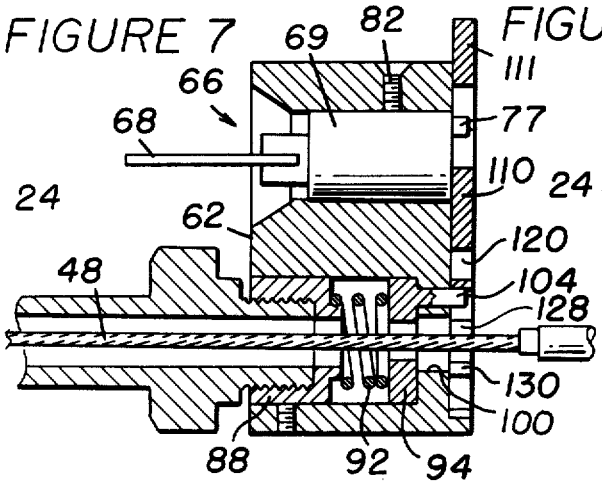
FIG. 7 is a side, sectional view similar to FIG. 5 with the lock in the open or untrapped position.
Figure 8:
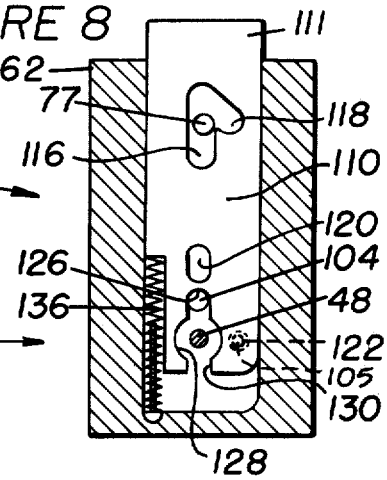
FIG. 8 is a right end elevation view, partially sectioned of FIG. 7.
Figure 9:
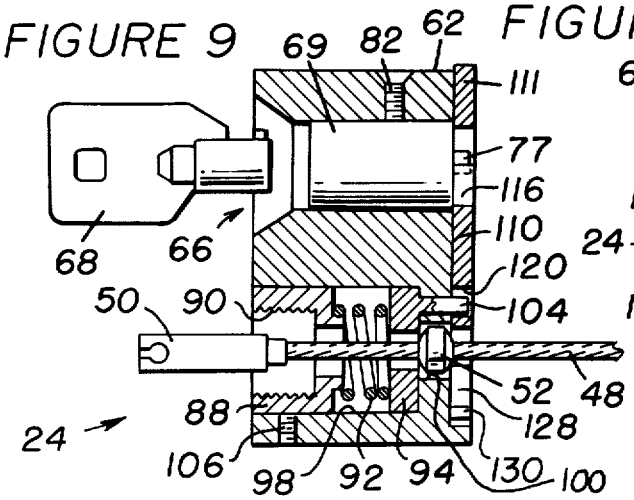
FIG. 9 is a sectional, side elevational view of the safety lock of the invention in the lock position.
Figure 10:
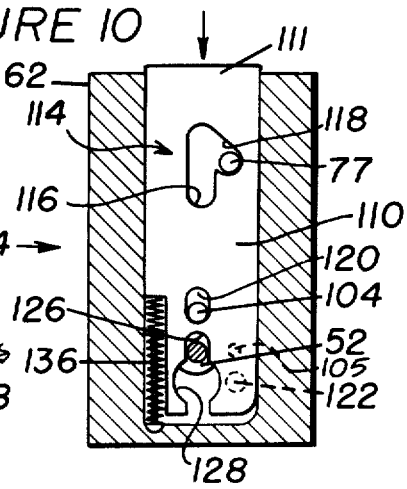
FIG. 10 is an right end elevation view, partially sectioned, of FIG. 9.

The fully locked position for the safety lock 24 is shown in FIGS. 9 and 10. As can be seen in FIG. 9, in the fully locked position, the key 68 can be removed from the key housing 69, so that said key can be stored separately from the exposure device 20 so that no unauthorized use can be made of the device. Further as the key is a cylinder type strong box key the likelihood of the cylinder lock 66 being opened by available substitutes for the key are remote. With the source 28 in the locked position, eccentric pin 77 is positioned in the lower end of the sloping portion 118 of aperture 114 to lock slide 110 in its lower most position. Simultaneously stop 52 is received in bore 100 and against receiver 94 and is retained therein as the upper portion 126 of aperture 124 is aligned with the bore 100 restricting the movement of stop 52. Pin 104 is urged through elongate bore 120 by the spring 92. To unlock the safety lock, the key 68 is inserted into the cylinder housing 69 and given a quarter turn to the right so that pin 77 is positioned at the upper end of the vertical portion 116 of aperture 114. Crank 32 is then cranked so that cable 38 is retracted, causing the stop 52 to urge annular receiver 94 rearwardly compressing spring 92 against receiving cylinder 88. As this occurs pin 104 is removed from elongated bore 120 and spring 136 urges slide 110 upwardly until slide 110 is stopped by eccentric pin 77 contacting the lower end of vertical portion 116 of aperture 114. With the slide 110 in this position (FIGS. 5, 6), tab 111 extends furthest from housing 62 and gives a visual indication to the operator that he is operating safety lock 24. Stop 52 is still trappingly retained in bore 100 by the lowermost portion 130 of additional aperture 124. At this point pin 104 is first received in aperture 124 between upper portion 126 and middle portion 128. In order to untrap the stop, the operator must urge the slide 110 downwardly into position as shown in FIGS. 7 and 8 so that pin 105 is received in indentation 122 so as to determine the position of slide 110. With slide 110 in said position, the middle portion 128 of aperture 124 is aligned with bore 100 so that crank 32 can urge stop 52 through said middle portion into the S-shape tube 44 of the shield 26 and simultaneously urge the source 28 out of the shield 26. It is to be understood, that in the positions shown in FIGS. 5, 6, 7, and 8, key 68 cannot be removed from the key housing 69 and thus no authorized copies of said key can be made.

Figure 5:
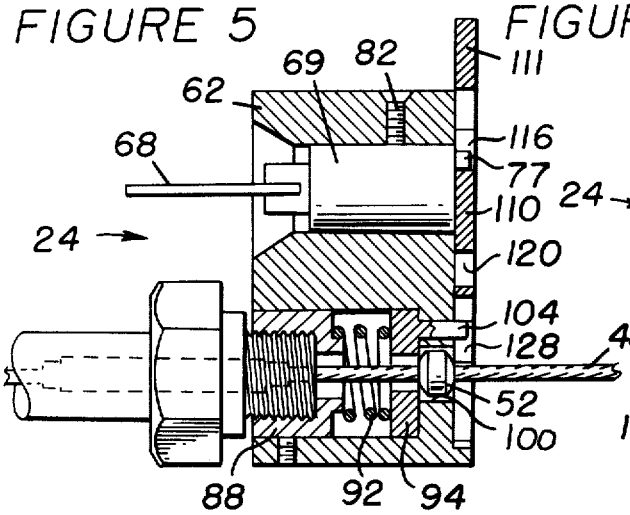
FIG. 5 is a side, sectional view of the safety lock of FIG. 4 in the trapped position.

After the radiography procedures are performed, the source 28 is retracted back into the shield 26 and the stop 52 is drawn through the middle portion 128 of the aperture 124 until it rests in bore 100. Retraction of stop 52 urges annular receiver 94 against spring 92 and receiving cylinder 88, so as to remove pin 104 from indentation 122 allowing spring 138 to urge slide 110 upwardly until tab 111 is in its upwardly most position as shown in FIGS. 5 and 6. Again, there is visual indication given by tab 111 that the stop 52 and thus the radiation source 28 are in the trapped position. At this point either the slide 110 can be reset into the positions of FIGS. 7 and 8, to allow the source 28 to be again extended from the shield 26 to do additional radiography, or lock 24 can be operated to place the slide in the positions of FIGS. 9 and 10 preparatory to removing key 68.

It is to be understood that with the lock in the position as shown in FIGS. 7 and 8, the stop 52 can always be received in the bore 100 so as to trap the stop 52 and thus the radiation source 28 in the shield 26 each time the source 28 is retracted into the shield 26. Thus, the safety lock does not prevent the return of this source to the shielded position.

Assuming that the radiography procedures are completed, and that the source is to be locked in the trapped position, tab 111 of slide 110 is urged downwardly after the cable has been retracted so as to remove pins 104 and 105 from the path of slide 110. Thus, slide 110 can be urged downwardly against spring 136 until eccentrically mounted pin 77 contacts the upper most portion of vertical aperture portion 116. In this position, upon the release of cable 38, the pin 104 is urged by spring 92 into elongated bore 120 as can be seen in FIGS. 9 and 10. The shorter pin 105 contacts the side of slide 110 at a point spaced from indentation 122. With the slide in this position the key can be turned in a counterclockwise manner to lock the slide in position.

With the eccentrically mounted pin 77 in the position shown in FIG. 10, the key 68 can be removed from the lock.

It is to be understood that bore 96 of annular receiver 94 has a diameter which is smaller than stop 52. Thus the source 28 can not be removed through the back of the safety lock through bore 96 even when the safety lock is in the unlocked and untrapped position.

As it can be seen that the above safety lock meets all the guidelines set forth by the Nuclear Regulatory Commission and is simpler and more efficient than the existing prior art. In particular, the present lock includes a housing 62 which is not easily removable from the shield with readily available tools as the housing is heli-arc welded to the shield, and thus, when the safety lock 24 is locked, it is difficult to remove the source of radiation from the shield except with the correct key. Also, the safety lock 24 does not prevent the return of the source into the shielded position as the safety lock only traps the stop 52 when it is in the position as indicated in FIGS. 5 and 6 so that the source of radiation is in the middle portion of the S-shaped tube 44. Additionally, it is not possible to unlock the safety lock 24 with an easily available substitute for the key as the key 68 is a cylinder type strong box key. Further, it is to be understood that it is not possible to operate the cylindrical key lock 66, due to the arrangement of slide 110, to remove said key 68 from key housing 69 until the stop 52 is trapped by slide 110 and thus until the source is in the fully shielded position in shield 26. Finally the tab 111 provides an indication of the position of source 28 and also the state of safety lock 24, thus reducing the chance of inadvertent exposure of the radiographer to the source of radiation.

Other aspects, objects and advantages of the invention can be obtained from the study of the drawings, the disclosure and the appended claims.

I claim:

1. A lock for securing a radiation source in a shield comprising:

a flexible member to which the radiation source is secured, which flexible member has a stop spaced from the radiation source;

means for trapping the stop, said means having a trapping and an untrapping position;

first means for biasing said trapping means to the trapping position;

means for receiving said stop having means for engaging said trapping means, said receiving and engaging means having an engaging position and a releasing position;

second means for biasing said receiving and engaging means toward the engaging position, wherein said engaging means can engage said trapping means in the untrapping position, and wherein said trapping means is urged to the trapping position by said first biasing means with the engaging means in the release position; and wherein said engaging means includes a pin and wherein said trapping means includes means for receiving said pin and wherein said pin is received in the pin receiving means of said trapping means to engage said trapping means in the untrapping position.

2. The apparatus of claim 1 wherein the flexible member has a connector spaced from the stop, the receiving means defining a passage for receiving the portion of the flexible member between the stop and the connector so that the connector extends out of the passage, wherein pulling on the connector moves said receiving and engaging means to the releasing position.

3. A lock for securing a radiation source in a shield comprising:

a flexible member to which the radiation source is secured, which flexible member has a stop spaced from the radiation source;

means for trapping the stop, said means having a trapping and an untrapping position;

first means for biasing said trapping means to the trapping position;

means for receiving said stop having means for engaging said trapping means, said receiving and engaging means having an engaging position and a releasing position;

second means for biasing said receiving and engaging means toward the engaging position, wherein said engaging means can engage said trapping means in the untrapping position, and wherein said trapping means is urged to the trapping position by said first biasing means with the engaging means in the release position; and wherein said trapping means has another trapping position and wherein said receiving means includes another engaging means for engaging said trapping means in the another trapping position.

4. The apparatus of claim 3 including key means for locking said trapping means in the another trapping position.

5. The apparatus of claim 3 wherein said lock includes a housing and said trapping means includes an indicator tab extending from said housing, and wherein said tab extends farther from said housing with the trapping means in the trapping position than in the untrapping position, and wherein said tab can be urged toward said housing against said first biasing means to position said trapping means in the untrapping position.

6. The apparatus of claim 3 wherein said trapping means defines an aperture which has a first portion elongated in the direction of travel of said slide and a second portion extending laterally from said first portion and wherein said lock includes means for locking said trapping means which is selectably positionable in said first portion of said aperture to allow said slide to move and in said second portion of said another aperture to lock said trapping means in the another trapping position.

7. The apparatus of claim 5 wherein said tab extends farther from said housing with said slide in untrapping position than in the another trapping position, and wherein with the engaging means in the release position said tab can be urged against said first biasing means to position said trapping means in the another trapping position.

8. The apparatus of claim 6 wherein said locking means includes a pin eccentrically mounted to a rotatable cylinder.

9. The apparatus of claim 8 including key means for rotating said rotatable cylinder.

10. A lock for securing a radiation source in a shield comprising:

a flexible member to which the radiation source is secured, which flexible member has a stop spaced from the radiation source;

means for trapping the stop, said means having a trapping and an untrapping position;

first means for biasing said trapping means to the trapping position;

means for receiving said stop having means for engaging said trapping means, said receiving and engaging means having an engaging position and a releasing position;

second means for biasing said receiving and engaging means toward the engaging position, wherein said engaging means can engage said trapping means in the untrapping position, and wherein said trapping means is urged to the trapping position by said first biasing means with the engaging means in the release position; and wherein said trapping means includes a slide having an aperture, a first portion of which allows said stop to pass therethrough and a second portion of which allows only said flexible member to pass therethrough and wherein said first position is aligned with said stop when said trapping means is in the untrapping position.

* * * * *